US005377070A

United States Patent [19]

Kawamoto

[11] Patent Number: 5,377,070

[45] Date of Patent: Dec. 27, 1994

[54] CHARGING APPARATUS FOR PHOTORECEPTOR

[75] Inventor: Hiroyuki Kawamoto, Ebina, Japan

[73] Assignee: Fuji Xerox Co., Ltd., Tokyo, Japan

[21] Appl. No.: 85,038

[22] Filed: Jul. 2, 1993

[30] Foreign Application Priority Data

Jul. 13, 1992 [JP] Japan ..... 4-207021

[51] Int. Cl.[5] ..... H01T 19/00; G03G 15/02

[52] U.S. Cl. ..... 361/229; 355/219

[58] Field of Search ..... 355/219, 221; 361/229, 361/220; 250/324–326; 430/902

[56] References Cited

U.S. PATENT DOCUMENTS

| | | | |
|---|---|---|---|
| 4,910,637 | 3/1990 | Hanna | 361/229 |
| 4,975,579 | 12/1990 | Iwanaga | 250/324 |

FOREIGN PATENT DOCUMENTS

| | | | |
|---|---|---|---|
| 61-27570 | 2/1986 | Japan | 355/219 |
| 62-296174 | 12/1987 | Japan | 355/219 |
| 1-2075 | 1/1989 | Japan | 355/219 |
| 1-321442 | 12/1989 | Japan | 355/219 |

OTHER PUBLICATIONS

Kutsuwada, "Discharge in Electrophotography", pp. 409–412, Japan, Dec. 1988.

Yamazaki, "Topics in Corona Discharge for Electrophotography", pp. 418–425, Japan, Dec. 1988.

Subbarao, Ed., "Solid Electrolytes And Their Applications", pp. 35–44, New York, 1980.

Schaffert, "Electrophotogoraphy", pp. 182–193, London, 1965.

*Primary Examiner*—Joan H. Pendegrass

*Attorney, Agent, or Firm*—Oliff & Berridge

[57] ABSTRACT

A charging apparatus is structured so as to charge the photoreceptive member without contacting it by providing electrode on at least one part of a solid electrolyte having an electric conductivity provided by oxygen ions, ionizing oxygen existing in the air surrounding the solid electrolyte by supplying a current to the electrode, removing the ions from the surface of the solid electrolyte and transferring them to the photoreceptive member.

7 Claims, 3 Drawing Sheets

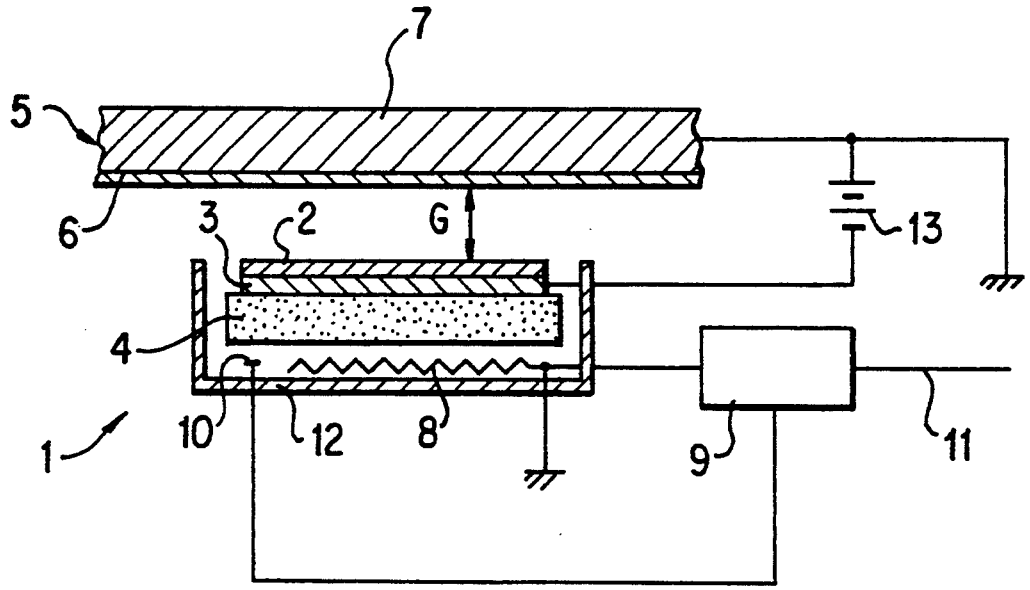
FIG. 1
FIG. 2(a)
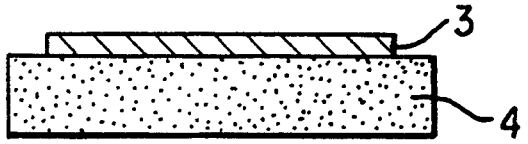
FIG. 2(b)
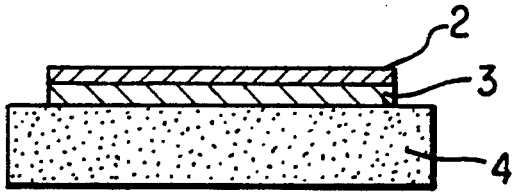

CHARGING APPARATUS FOR PHOTORECEPTOR

FIELD OF THE INVENTION

The present invention relates to a charging apparatus used in an image-forming apparatus such as a copying machine, a printer or the like, and especially to a charging apparatus free of accumulation of discharge products, not generating ozone and capable of providing long-term stable charging quality.

BACKGROUND OF THE INVENTION

As shown in FIGS. 4 and 5, a charging apparatus 100 so-called corotton, an example of a conventionally used charging apparatus in a copying machine, a printer or the like comprises insulating fixing member end blocks 102 installed at both ends of the metal shield member 101 and a metal discharge wire 103 supported between the end blocks 102 with a specified tension. An end of the discharge wire is fixed to one end block 102 by a screw 104, and the other end of the wire having a spring 105 is fixed to the other 102 by another screw 104. The shield member 101, as shown in FIG. 5, is disposed so as to surround the discharge wire 103 except where the wire faces a photoreceptor drum 106 of a copying machine or the like. The distance between the walls of the shield member 101 and the discharge wire 103 and the distance between the discharge wire 103 and the photoreceptor drum 106 are arranged to be approximately in the range from 8 to 15 mm. The discharge wire 103 is a wire of tungsten having a diameter of 30 to 100 $\mu$m. Aluminum, stainless steel or metal plated steel plate is used for the material of the shield member 101, and synthetic resin is used for the end blocks 102.

in the thus structured charging apparatus 100, as shown in FIG. 5, a voltage which is at least equal to a corona discharge starting voltage (usually some kV) whose level is mainly determined by the diameter of the discharge wire 103 and a distance between the shield member 101 is applied to the discharge wire 103 by a power supply 107, which forms a large electric field around the surface of the discharge wire 103 as shown in FIG. 6, and partial dielectric breakdown, namely corona discharge is produced inside the electric field R. According to the principle of corona discharge, stable discharge is maintained in the vicinity of the wire 103. In the charging apparatus 100, uniform charging on the surface of the photoreceptor drum 106 is carried out by moving ions produced by the corona discharge to the surface of the photoreceptor drum 106 through the electric field formed between the discharge wire 103 and the photoreceptor drum 106 and attaching the ions to the surface of the photoreceptor drum 106.

Documents such as "Denshishashin ni okeru coronahouden" (Corona Discharge in Electrophotography) N. Kutsuwada, Seidenkigakkai-shi, Vol. 12/6, 1988, pp. 409–412 and "Denshishashin no coronahoudensouchi no kadai (Topics in Corona Discharge for Electrophotography" N. Yamazaki, Seidenkigakkai-shi, Vol. 12/6, 1988, pp. 418–425, however, describe various problems in the conventional art, because a conventional charging apparatus 100 is structured so as to produce ions, using corona discharge, to charge the photoreceptor drum 106 of the copying machine or the like.

First, if the charging apparatus 100 using corona discharge is operated for a long time, discharge products which are insulating solids mainly comprising $SiO_2$ form on the discharge wire 103, which prevents the surface from producing a corona discharge easily. It lowers the corona current and leads to a decline of copy image density and non-uniformity.

Second, corona discharge of the charging apparatus 100 produces ozone, which not only impairs the quality of the photoreceptive member but also, if the amount is significant, is harmful to humans. Therefore, it is necessary to, provide an ozone filter in a copying machine to prevent the leakage of ozone.

SUMMARY OF THE INVENTION

It is an object of the present invention to provide a charging apparatus free of the defects found in the conventional art.

It is another object of the present invention to provide a charging apparatus which is stable for a long time and free of discharge products or ozone.

Additional objects and advantages of the invention will be set forth in part in the description which follows and in part will be apparent to a person with ordinary skill in the art from the description, or may be learned by practice of the invention.

BRIEF DESCRIPTION OF THE DRAWING

The manner by which the above objects and other objects, features and advantages of the present invention are attained will be fully evident from the following detailed description when it is considered in light of the accompanying drawings, wherein:

FIG. 1 illustrates the structure of an embodiment of a developing apparatus according to the present invention.

FIGS. 2(*a*) and 2(*b*) illustrates the manufacturing process of the charging apparatus according to the present invention.

Figure 3:
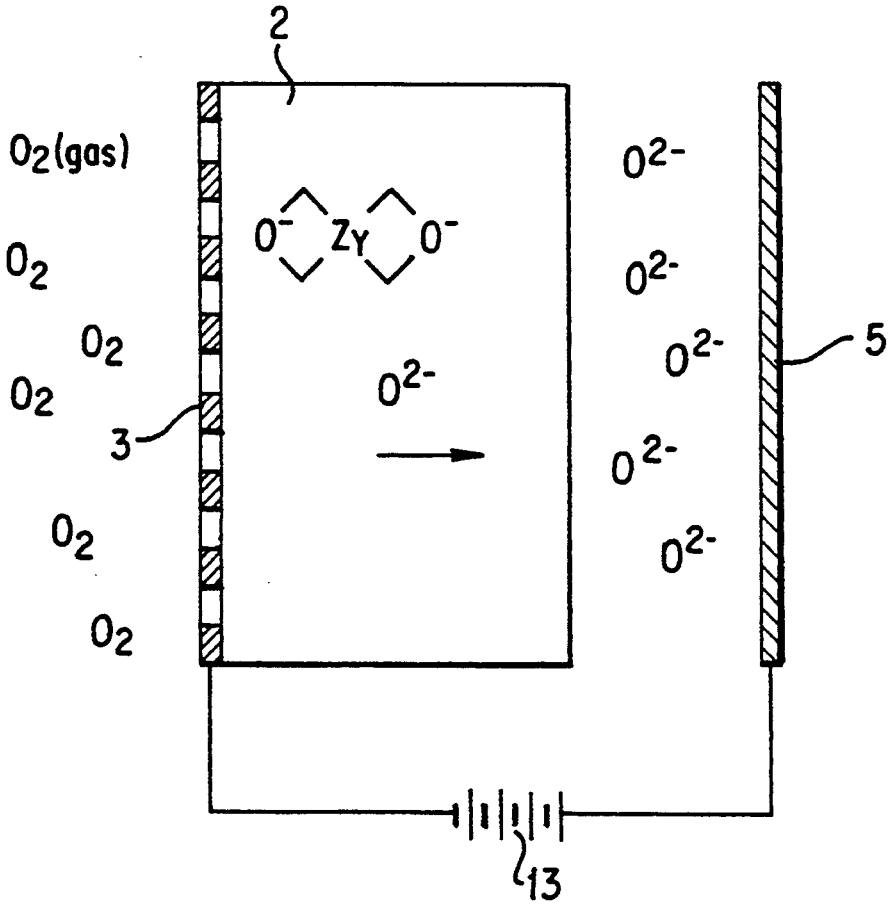
FIG. 3 illustrates the mechanism of an embodiment of the charging apparatus according to the present invention.
Figure 6:
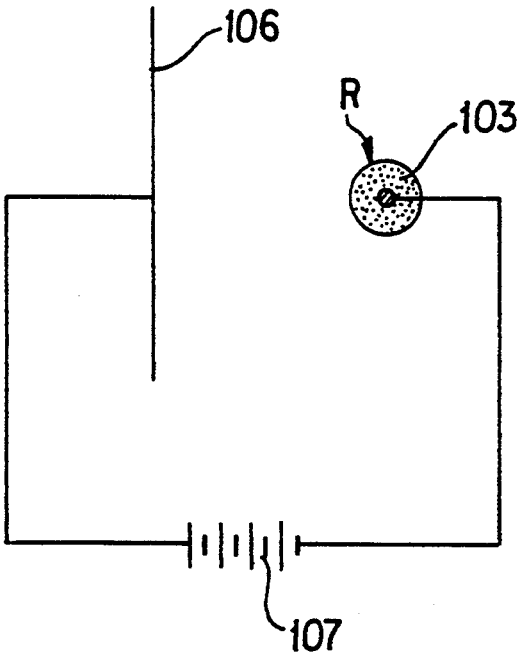
FIG. 6 illustrates the mechanism of a conventional charging apparatus.
Figure 4:
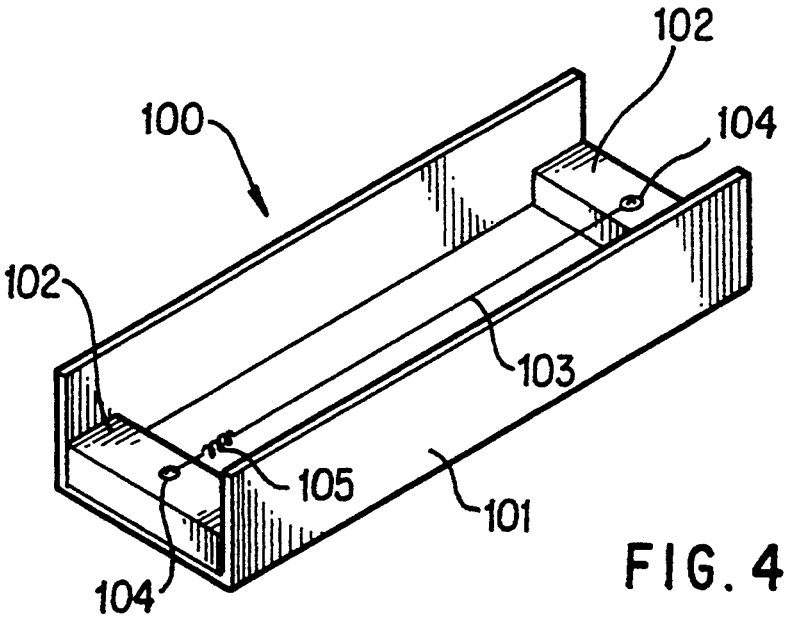
FIG. 4 is a schematic view of a conventional charging apparatus.
Figure 5:
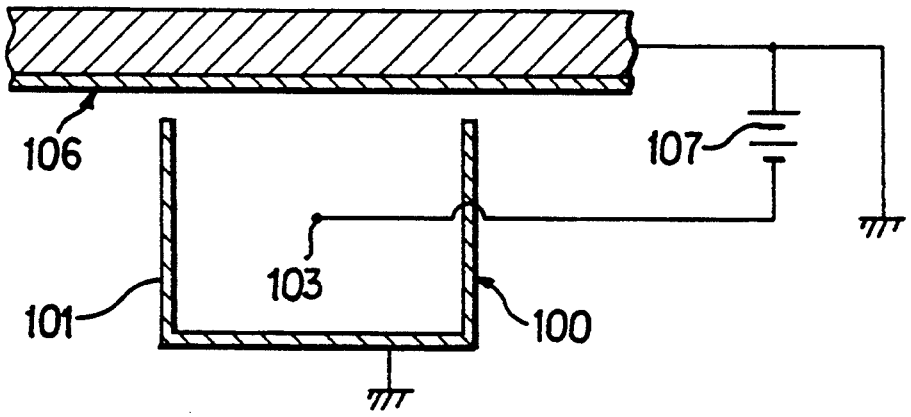
FIG. 5 is a cross-sectional view of a conventional charging apparatus.

The charging apparatus according to the present invention is structured so as to charge the photoreceptive member without contacting it by providing electrodes on at least one part of a solid electrolyte having an electric conductivity provided by oxygen ions, ionizing the oxygen in the air surrounding the solid electrolyte by supplying a current to this electrode, thus removing ions from the surface of the solid electrolyte and transferring them to the photoreceptive member.

For the solid electrolyte, for example, yttria stabilized zirconia is used, and other materials such as calcium oxide stabilized zirconia may also be used. Stabilized or partially stabilized zirconia of other molecules may also be used. These materials are concretely written in "Solid Electrolytes and Their Applications" C. B. Choudhary, H. S. Maiti and E. C. Subbardo, Edited by E. C. Subbardo, 1980, pp. 35–44, Plenum Press, N.Y.

For the material of the electrode, for example, platinum or another metal may be used.

If platinum is used for the electrode, the platinum electrode is formed by applying platinum paste to the solid electrolyte, then drying and firing. In this case, the platinum electrode and the solid electrolyte may be formed by applying platinum paste to the surface of a porous body, further applying solid electrolyte and then drying, firing and sintering.

On the electrode side of this solid electrolyte, for example, a heating means may be disposed.

Furthermore, a metal shield member may be provided around the solid electrolyte, if necessary.

DETAILED DESCRIPTION OF THE PRESENT INVENTION

In the present invention, the solid electrolyte of yttria stabilized zirconia or the like is a good conductor of oxygen ions. If porous metal electrodes are disposed in close contact with both sides of the solid electrolyte which is in the form of a plate, for example, and a voltage is applied between these electrodes in a space containing oxygen, such as the air, molecular oxygen obtains electrons from the cathode and is ionized, whereupon the oxygen ions migrate to the anode through the solid electrolyte. The oxygen ions emit electrons in the interface with the anode, and they return to be molecular oxygen. Emitted electrons circulate to the cathode from the anode through the power supply, and then again contribute to ionization of the molecular oxygen.

With the charging apparatus of the present invention, charging without contacting the photoreceptive member is carried out by disposing a cathode or an anode on at least one part of the solid electrolyte, with the other electrode spaced apart by the air on the side of the object to be charged, taking out the oxygen ions migrating through the solid electrolyte in the air and depositing the charge caused by this process on the photoreceptive member.

EMBODIMENT

The present invention is now described referring to the embodiments shown in the figures.

FIG. 1 illustrates an embodiment of the charging apparatus according to the present invention.

In FIG. 1, 1 is a charging apparatus and its main portion comprises a solid electrolyte 2 formed in the form of a thin plate, a porous body 4 formed in the form of a thin plate and fixed to the electrode 3 which is formed on the solid electrolyte 2. The charging apparatus 1 is disposed with the surface of its solid electrolyte 2 facing the photoreceptor drum 5, which is a charged member, with a spacing G. The photoreceptor drum 5 is formed by laminating a photoreceptive layer 6 on the surface of the conductor 7.

For the material of the solid electrolyte 2, for example, yttria stabilized zirconia or calcium oxide stabilized zirconia having a good conductivity of oxygen ions present in the air may be used. Zirconia stabilized or partially stabilized by other molecules may also be used.

It is preferable that the solid electrolyte 2 is as thin as possible so that the ionic conduction resistance is reduced, which contributes to keeping the overpotential inside the solid electrolyte 2 as low as possible, and the appropriate thickness of the solid electrolyte 2 is not more than 0.1 mm. On the other hand, there is no restriction on the width and length of the solid electrolyte 2, but if the width thereof is determined in accordance with that of a conventional corotron, it is 16 to 30 mm. Similarly, if the length is determined in accordance with the width of the recording medium, which is typically the longer side of a sheet of A4 paper, it is 300 mm approximately. The smaller the gap G between the solid electrolyte 2 and the photoreceptor drum 5, the lower voltage is required to obtain the desired amount of charging current, so it is preferable that the gap G is as small as possible, but from the constraint of mechanical accuracy, a range from 0.1 to 5 mm is preferable.

For the material of the electrode 3, for example, platinum is used, in view of its function as a catalyst, but other metals may also be used.

The porous body 4 is porous so as not to prevent the diffusion of oxygen and it is formed of a insulating material, for example, a porous alumina plate. It is preferable that the porous body 4 is as thin as possible while maintaining its strength as a substrate, preferably in the range from 0.1 to 10 mm approximately, so that the heat from the heater is conveyed to the solid electrolyte 2 easily.

Generally, the solid electrolyte 2 is highly resistive at ambient temperature, but it shows good ion conduction as the temperature rises, so in order to obtain a desired current with a relatively low voltage, it must be heated. Therefore, in this embodiment, a heater 8 to heat the solid electrolyte 2 is disposed between the porous body 4 and the shield member 12. Current supply to the heater 8 is controlled by a temperature control device 9, by which the solid electrolyte 2 is kept at the specified temperature. As a temperature controlling method, may be used any known method such as controlling the supply of electric power from the temperature controlling power supply 11 to the heater 8 by means of the temperature controlling device 9 according to the temperature measured by a thermocouple 10.

In FIG. 1, 12 is a shield member disposed to surround the solid electrolyte 2 and the porous body 4, and in the same way as in a corotron it stabilizes the output current and prevents the charge from the solid electrolyte 2 from being dissipated in the portions other than the photoreceptor drum 5 which is facing the solid electrolyte 2. For this reason, the portion facing the photoreceptor drum 5 of the shield member 12 is open. Materials usable for the shield member 12 are the same as those used in a corotron, namely, aluminum, stainless steel or metal plated steel plate, and the shield member 12 is grounded. If the gap G between the photoreceptive member and the solid electrolyte 2 is small enough not to allow the charge to be dissipated, the shield 12 is not necessary.

A high DC voltage is applied between the platinum electrode 3 and the conductor 6 of the photoreceptor drum 5 from a DC power supply 13.

The manufacturing process of a thus structured charging apparatus is now described.

The platinum electrode 3 is formed by applying platinum paste 3 at a specified thickness on the porous alumina plate which is already fired and used as the porous body 4 as shown in FIGS. 2(*a*) and 2(*b*), drying the organic binder contained in the platinum paste 3 at a temperature in the range from ambient temperature to around 200° C., and then firing at a temperature of 1000° C. approximately. If such a thick film forming is used, the fired electrode film of platinum 3 is porous and does not prevent the ionization of oxygen in the surface of the solid electrolyte 2, which is preferable.

Next, a zirconia solid electrolyte 2 is formed by applying zirconia powder including a binder on the platinum electrode 3 which is thus formed on the porous body 4 and sintering at a high temperature, of at least 1000° C.

A charging apparatus 1 is manufactured by locating and fixing the thus integrally formed solid electrolyte 2, platinum electrode 3 and porous body 4 together with a heater 8 or the like inside the shield member 12.

The platinum electrode 3 and the zirconia solid electrolyte 2 may be laminated in sequence on the porous body 4 and be sintered at the same time with the porous body 4.

Charging carried out by a thus structured charging apparatus according to this embodiment is now described. In this charging apparatus 1, as shown in FIG. 1, a high DC voltage is applied between the platinum electrode 3 and the conductor 7 of the photoreceptor drum 5 from a DC power supply 13.

The solid electrolyte 2 of yttria stabilized zirconia or the like having the platinum electrode 3 thereon is known as a good conductor of oxygen ions, the ions of oxygen in the air. Therefore, on the surface of the solid electrolyte 2 having platinum electrode 3, as shown in FIG. 3, oxygen molecules $O_2$ in the air are ionized and become oxygen ions $O_2^{2-}$ by obtaining electrons $e^-$ from the platinum cathode 3, migrate to the anode through the solid electrolyte 2 and reach the other side of the solid electrolyte 2. Oxygen ions $O_2^{2-}$ which reach the other side of the solid electrolyte 2 deposit a charge on the surface of the photoreceptor drum 5 by the electric field E formed between the platinum electrode 3 and the photoreceptor drum 5 and charge the photoreceptive layer 6 disposed on the surface of the drum 5 without contacting the photoreceptive layer.

The electric field E of the charging apparatus according to this embodiment is formed between a couple of parallel electrodes, the platinum electrode 3 and the conductor 7 of the drum 5. If the applied voltage V of the DC power supply 13 is 1 kV and the gap G between the solid electrolyte 2 and the photoreceptor drum 5 is 1 mm, the strength of the electric field E is:

$$E=V/G\approx 10\ \text{kV/cm}$$

On the other hand, if the radius r of the discharge wire is $1.5\times 10^3$ cm according to "Electrophotography" R. M. Schaffert, second Edition, Focal Press, London, 1975, the electric field E formed around the surface of the discharge wire 103 of a conventional corotron is:

$$E=31\ m\delta\{1+0.308/(r\delta)^{-\frac{1}{2}}\}\approx 280\ \text{kV/cm}$$

Here, m is an irregular constant and $\delta$ is a constant according to the kind of gas.

The electric field E of the charging apparatus 1 according to this embodiment is smaller than that of a conventional charging apparatus by more than an order of magnitude, and the amount of discharge products attached to the apparatus which is proportional to the strength of the electric field E decreases significantly, compared with that of a conventional corotron. If the length parallel to the conductor 6 of the solid electrolyte 2 of the charging apparatus according to this embodiment is 2 cm, the surface area, the discharge surface of the solid electrolyte 2 is $2/(1.5\times 10^{-3})\approx 1300$ times as large as that of the conventional corotron, so the charging uniformity is not varied even if very small foreign matter is attached to the surface of the solid electrolyte 2.

As reported in "Denshishashin no coronahoudensouchi no kadai" (Topics in Corona Discharge for Electrophotography) N. Yamazaki, Seidenkigakkai-shi, Vol. 12/6, 1988, pp. 418–425, in a charging apparatus using corona discharge, ozone is produced where the electric field is concentrated around the surface of the discharge wire, but in the charging apparatus i according to this embodiment, as the electric field is not concentrated very much, the amount of ozone produced there is reduced significantly. Therefore, it is not necessary to provide an ozone filter for preventing the leakage of ozone, which simplifies the structure of the apparatus.

Further, with the charging apparatus according to this embodiment, as corona discharge is not used, a voltage as high as the corona discharge initial voltage (some kV) need not be applied, and this lowers the required voltage of the power supply, which economizes charging and simplifies the insulation requirements.

A grid electrode may be disposed in the open portion of the shield member 12.

What is claimed is:

1. A charging apparatus which is structured so as to charge a photoreceptive member without contacting it comprising an electrode on at least one part of a solid electrolyte comprising yttria stabilized zirconia or calcium oxide stabilized zirconia and a means of applying dc voltage attached to the electrode.

2. The charging apparatus described in claim 1, wherein the electrode is made of platinum.

3. The charging apparatus described in claim 2, whose platinum electrode is formed by applying platinum paste to the solid electrolyte and then drying and firing.

4. The charging apparatus described in claim 2, wherein the platinum electrode and the solid electrolyte are formed by applying platinum paste to a surface of the porous body, further applying solid electrolyte to the platinum paste and then drying, firing and sintering.

5. The charging apparatus described in claim 1, in which a heating means is disposed on the electrode side of the solid electrolyte.

6. The charging apparatus described in claim 1, in which a metal shield member is disposed around the solid electrolyte.

7. A method of charging a photoreceptive member without contacting it, comprising the steps of providing a charging apparatus comprising an electrode on at least one part of a solid electrolyte comprising yttria stabilized zirconia or calcium oxide stabilized zirconia and having an electric conductivity provided by oxygen ions, ionizing oxygen in the air surrounding the solid electrolyte by supplying a current to the electrode by a means of applying dc voltage attached to the electrode, removing ions from a surface of the solid electrolyte and transferring them to the photoreceptive member, said photoreceptive member not being in physical contact with the charging apparatus.

* * * * *